US006132239A

United States Patent [19]

Nærland

[11] Patent Number: 6,132,239

[45] Date of Patent: Oct. 17, 2000

[54] TERMINAL FOR A CONDUCTOR

[75] Inventor: Geir Nærland, Drøbak, Norway

[73] Assignee: Telesafe AS, Asker, Norway

[21] Appl. No.: 09/174,413

[22] Filed: Oct. 19, 1998

[51] Int. Cl.[7] ..... H01R 4/24

[52] U.S. Cl. ..... 439/439; 439/441

[58] Field of Search ..... 439/439, 440, 439/441, 442

[56] References Cited

U.S. PATENT DOCUMENTS

| | | | |
|---|---|---|---|
| Re. 27,743 | 8/1973 | Weimer, Jr. | 439/442 |
| 1,631,719 | 6/1927 | Chandler | 439/442 |
| 2,694,188 | 11/1954 | Poupitch | 439/442 |
| 3,008,117 | 11/1961 | Feustel et al. | 439/439 |
| 3,183,471 | 5/1965 | Burkert | 439/442 |
| 3,541,226 | 11/1970 | Cea et al. | 439/442 |
| 3,748,634 | 7/1973 | Barnes et al. | 439/852 |
| 3,752,901 | 8/1973 | Kuo | 439/442 |
| 3,828,298 | 8/1974 | Schumacher | 439/442 |
| 3,831,132 | 8/1974 | Bowden, Jr. et al. | 439/442 |
| 4,304,454 | 12/1981 | Yokoata et al. | 439/442 |

*Primary Examiner*—Paula Bradley
*Assistant Examiner*—Katrina Davis
*Attorney, Agent, or Firm*—Wenderoth, Lind & Ponack, L.L.P.

[57] ABSTRACT

A single conductor in a multi-conductor cable is connected to a terminating part on a contact pin or contact socket in a plug or a socket contact, possibly on a circuit board or a contact piece, by inserting a stripped, metallic center conductor longitudinally between at least one pair of gripping claws of an electrically conductive material. The gripping claws are shaped so that an inner, substantially forward facing and sharp edge portion touches the surface of the metallic conductor along a substantially helical curve having a large pitch angle. Thereby, if an attempt is made to pull the conductor in a rearward direction, the sharp edge portion will carve lockingly into the surface of the metallic conductor and cause locking of the conductor.

40 Claims, 4 Drawing Sheets

3
4
5
6
7
8
9
10
11
12
13
14
15
17
18

TERMINAL FOR A CONDUCTOR

BACKGROUND OF THE INVENTION

The present invention concerns the problem of terminating or connecting an electrical conductor to a contact pin or a contact socket in a plug or a socket contact or connector without using a terminating tool. In particular, the invention relates to a contact pin and a contact socket having a terminating part of a special type for tool-free terminating or connecting thereto of a solid conductor in a cable.

An electrical contact assembly usually includes a plug or male contact having a number of contact pins mounted in a contact housing, and a socket contact or female contact having a corresponding number of contact sockets mounted in a contact housing. In some cases the contact assembly may comprise hermaphroditic contacts, with a mixture of contact pins and contact sockets in each respective one of two contact pieces that are principle of the same type. In such cable contacts of plug, socket contact and hermaphroditic contact type, the electric cable conductors are terminated or connected permanently to the respective contact pins and contact sockets using various terminating methods. Examples of such methods are:

- terminating cable conductors on knife contacts, or by fixing contact pins/sockets to the conductors by crimping. These methods require special tools;
- terminating by means of a screw connection or by soldering. These methods do not require special tools, but are usually relatively time-consuming.

SUMMARY OF THE INVENTION

The present invention offers an alternative arrangement for permanent terminating or connection of a conductor, preferably in a low current cable, to a contact pin or a contact socket, without use of any terminating tool. The invention may form part of contact solutions for cables having one or several conductors with solid, i.e. not multi-strand, metallic conductor core or cores. The invention is suitable for transmission of electrical signals having frequencies from 0 (DC) to beyond 1 GHz. Terminating by means of contact pin/contact socket in accordance with the invention will only require preparation amounting to stripping insulation from a forward piece of the insulated conductor (normally several such insulated conductors are included in a cable). Further, the invention is intended for once-for-all terminating or connecting, i.e. wherein when the conductors have been attached, they are not intended to be released again from the pin/socket terminal.

The invention provides a quick and simple manner for terminating or connecting conductors in contact housings, with no other special tool than a stripping tool.

Hence, in a first aspect of the invention there is provided a contact pin for use in a plug or a socket contact or connector, possibly together with further contact pins, such contact pin having a forward engagement pin part to be entered into a contact socket in a socket contact or a plug, and a rear terminating pin part for tool-free terminating or connecting thereto of a conductor in a cable, such conductor including an insulation sheath and a central metallic conductor which is solid and has a substantially circular cylindrical surface. The terminating pin part in accordance with the invention includes at least one pair of gripping claws made of an electrically conductive material to provide a good electrical connection with the metallic conductor by springy and tight envelopment when the conductor is inserted in a forward direction between the gripping claws. Each claw in a pair has an inner, substantially forwardly-facing and sharp edge shaped in such a manner that when the metallic conductor has been inserted, a portion of the sharp edge touches the surface of the metallic conductor along a substantially helix-shaped curve having a large pitch angle, so that the forwardly-facing edge portions will carve into the surface of the metallic conductor and lock the metallic conductor if an attempt is made to pull the conductor in a rearward direction with a reasonable pulling force.

In a second aspect of the invention there is provided a contact socket for use in a socket contact or a plug, possibly together with further contact sockets, such contact socket having a forward engagement socket part to envelop tightly a contact pin in a plug or a socket contact, and a rear terminating socket part for tool-free terminating or connecting thereto of a conductor in a cable, such conductor including an insulation sheath and a central metallic conductor which is solid and has a substantially circular cylindrical surface. The terminating socket part in accordance with the invention includes at least one pair of gripping claws made of an electrically conductive material to provide a good electrical connection with the metallic conductor by springy and tight envelopment when the conductor is inserted in a forward direction between the gripping claws. Each claw in pair has an inner, substantially forwardly-facing and sharp edge shaped in such a manner that when the metallic conductor has been inserted, a portion of the sharp edge touches the surface of the metallic conductor along a substantially helix-shaped curve having a large pitch angle, so that the forwardly-facing edge portions will cut into the surface of the metallic conductor and lock the metallic conductor if an attempt is made to pull the conductor in a rearward direction with a reasonable pulling force.

In both of the above stated aspects of the invention, the terminating part may include a successive row of pairs of gripping claws having a gradually narrower passage for the metallic conductor, for reception and terminating or connecting of metallic conductors having various diameters.

In the case with a row of pairs of gripping claws, the first pair of gripping claws in the row to be entered by a stripped conductor to be terminated preferably may be provided with an outwardly opening, funnel-like conductor insertion part at the insertion end to simplify insertion of the tip of the metallic conductor.

In a preferred embodiment of the invention, the terminating part, possibly the complete contact pin or contact socket, is formed from a flat metal piece by stamping and bending.

In the preferred embodiment of the invention, each gripping claw extends from a base part that is substantially longitudinal in relation to the metallic conductor, cylindrically curving and transverse relative to the base part, via a narrow neck section to a top part which has a largest dimension extending in the longitudinal direction when the metallic conductor is held. Such top part has an end edge which then faces and is substantially parallel to a corresponding end edge of the other gripping claw in the pair. However, the top part end edge is inclined at an oblique angle to the longitudinal direction of the metallic conductor prior to insertion thereof. Each gripping claw has the above mentioned sharp edge in a forward region from the neck section and in the top part.

In a third aspect of the invention there is provided a contact assembly that comprises a plug and a socket contact, preferably for use with a low current cable, wherein the plug and the socket contact comprise contact pins and contact sockets intended for mutual engagement, and wherein the contact pins and contact sockets are such as stated in the first two aspects of the invention.

In a fourth aspect of the invention there is provided a cable terminating part for use on a circuit board or a contact piece, for tool-free terminating or connecting thereto of a conductor in a cable, such conductor including an insulation sheath and a central metallic conductor which is solid and has a substantially circular cylindrical surface. The terminating part is adapted to receive the metallic conductor by a forward insertion movement in a longitudinal direction of the terminating part. The terminating part includes at least one pair of gripping claws made of an electrically conductive material to provide a good electrical connection with the metallic conductor by springy and tight envelopment when it is inserted in a forward direction between the gripping claws. Each claw in a pair has an inner, substantially forwardly-facing and sharp edge shaped in such a manner that when the metallic conductor has been inserted, a portion of the sharp edge touches the surface of the metallic conductor along a substantially helix-shaped curve having a large pitch angle, so that the forwardly-facing edge portions will cut into the surface of the metallic conductor and lock the metallic conductor if an attempt is made to pull the conductor in a rearward direction with a reasonable pulling force.

BRIEF DESCRIPTION OF THE DRAWINGS

In the following, the invention shall be described in more detail with reference to preferred embodiments that appear from the appended drawings, wherein.

DETAILED DESCRIPTION OF THE INVENTION

Figure 1:
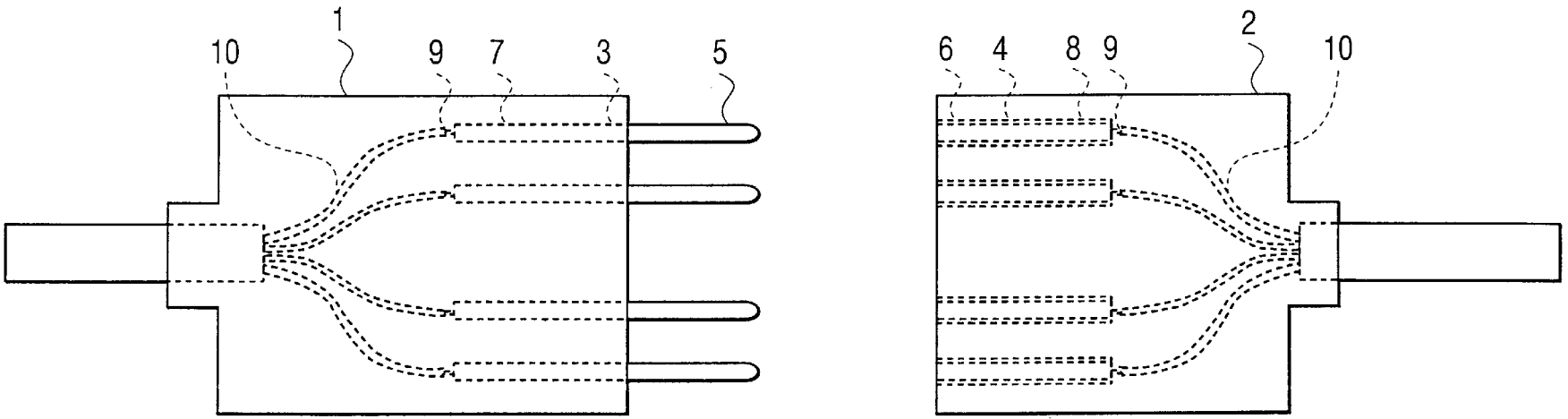
FIG. 1 shows schematically and in a general form a simple contact assembly including a plug with contact pins as well as a corresponding socket contact with contact sockets.

FIG. 1 shows a general design of a simple contact assembly comprising a male contact or plug 1 having four contact pins 3, arranged to provide connection with a female contact or socket contact or connector 2 which comprises four contact sockets 4. Assembled cables enter the plug and the socket contact, and branch into four insulated conductors 10, each containing a metallic conductor 9. Every metallic conductor 9 is in some way or other attached, i.e. terminated, to the rear end 7 or 8 of a respective contact pin 3 or of a respective contact socket 4. The manner of terminating is not apparent from this figure, which merely shows in a general manner a contact assembly. The forward parts 5 of the contact pins are intended to engage the forward parts 6 of the contact sockets. The contact assembly shown here is merely an example, the number of pins and sockets may of course be quite different, and it is also possible to have hermaphroditic contact assemblies where each contact piece 1, 2 comprises pins 3 as well as sockets 4. The manner of attaching the metallic conductor 9 to the rear end 7 or 8 of the respective pin 3 or socket 4 can in general be one of the manners mentioned above, but in the present invention there is a special and novel method of terminating the metallic conductor 9 to the respective rear end 7 or 8. When the invention is discussed in the following, the rear end of a respective pin 3 or socket 4 will be termed terminating part 7 or 8, respectively.

Figures 2A, 2B, 2C, 2D:
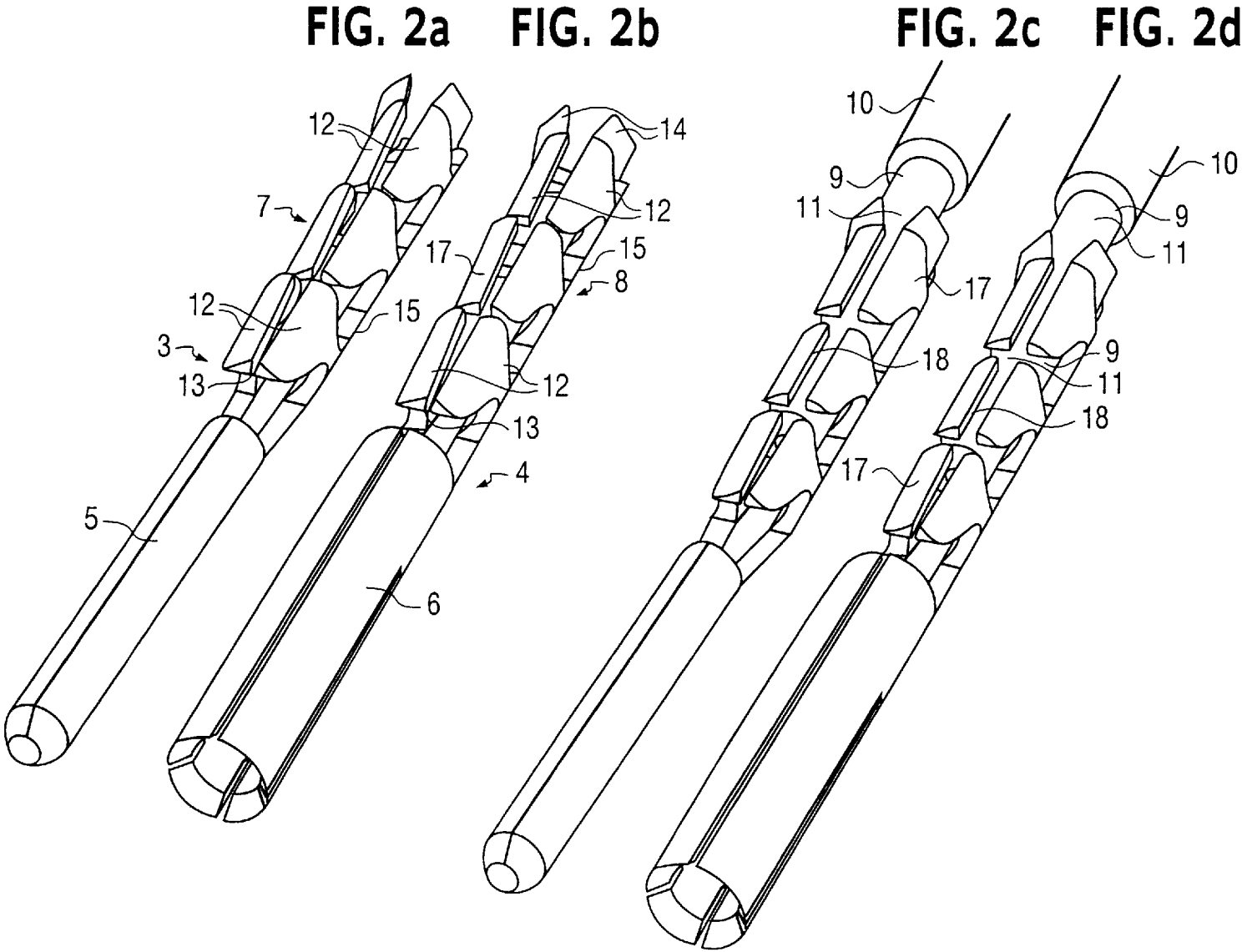
FIGS. 2*a* and 2*a* show a preferred embodiment of the invention, i.e. a contact pin and a contact socket, respectively, with terminating parts of a special type.
FIGS. 2*c* and 2*d* show the same as FIGS. 2*a* and 2*b*, however with conductors inserted in the terminating parts.

A preferred embodiment of the invention appears from FIGS. 2*a* and 2*b*, i.e. the same type of terminating part 7, 8 is here shown at the rear end of a contact pin 3 or a contact socket 4. In the following the terminating parts 7 and 8 are treated in the same manner, i.e. it is sufficient to discuss one terminating part. However, for practical reasons, reference numerals appear distributed equally in FIGS. 2*a* and 2*b*.

In this embodiment, an elongated terminating part has a base part 15 having extending therefrom three pairs erect structures 12 in the form a gripping claws adapted to enclose a circular cylindrical conductor to be inserted from the rear and in a direction forwardly toward the engagement pin part 5 or the engagement socket part 6. Each claw 12 is substantially or almost semi-cylindrical as will be apparent from FIGS. 3*c* and 4*c*. The terminating part may comprise only one such pair of gripping claws 12, or possibly two, three or more pairs of gripping claws 12. If there is only one pair of gripping claws 12, the terminating part will be suitable for one special conductor diameter, but to be able to receive and retain fixedly conductors having diameters within a specified diameter range, a number of such pairs of gripping claws may be arranged in a row, where the rearmost pair of gripping claws is adapted to the larger diameter in the specified range, and the forward most pair of gripping claws is adapted to the smaller diameter in this range, while intermediate pairs of gripping claws are adapted to successively decreasing diameters for the rear toward the front. When a conductor is inserted, it will pass easily through the larger pair gripping claws, while it will be held in the respective adapted pair of gripping claws 12.

In FIGS. 2*c* and 2*d* is shown, in a manner corresponding to FIGS. 2*a* and 2*b*, the same contact pin and contact socket, however in a situation where metallic conductor 9 has entered through the rear pair of gripping claws 12 to be retained in the intermediate pair of gripping claws. This means that the forward most pair of gripping claws is still not under any tension, the intermediate pair of gripping claws is taunted in a manner to retain the circular cylindrical conductor, while the rearward pair of gripping claws has been pivoted somewhat from its start position, but not to a sufficient degree to retain the metallic conductor 9. The gripping claws 12 are shaped in a special manner and are arranged in pairs. They operate in accordance with a spring-action locking principle, which is most easily explained in connection with FIGS. 3*a*–4*c*. Such figures therefore are referred to in the following. However, FIGS. 2*a*–D will also illustrate some of the geometry that is important for the invention.

Figure 3A:
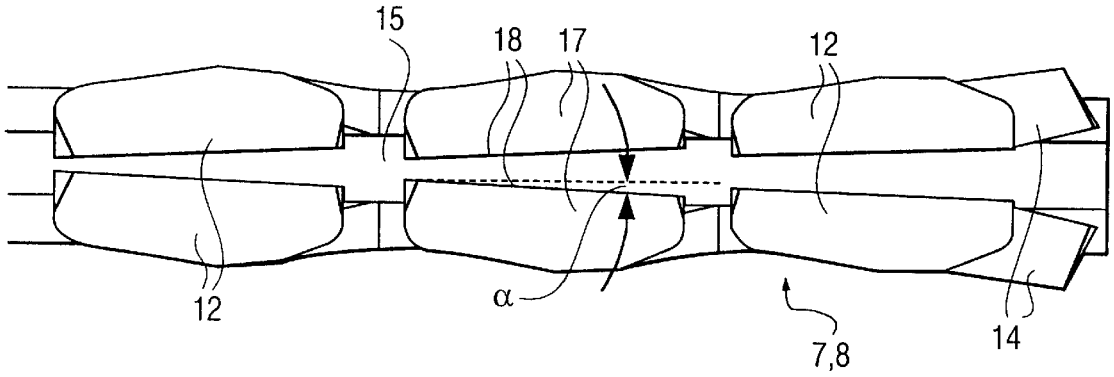
FIGS. 3*a*–3*c* show preferred embodiment of an actual terminating part, in top view, side view and cross sectional view, respectively.
Figure 3B:
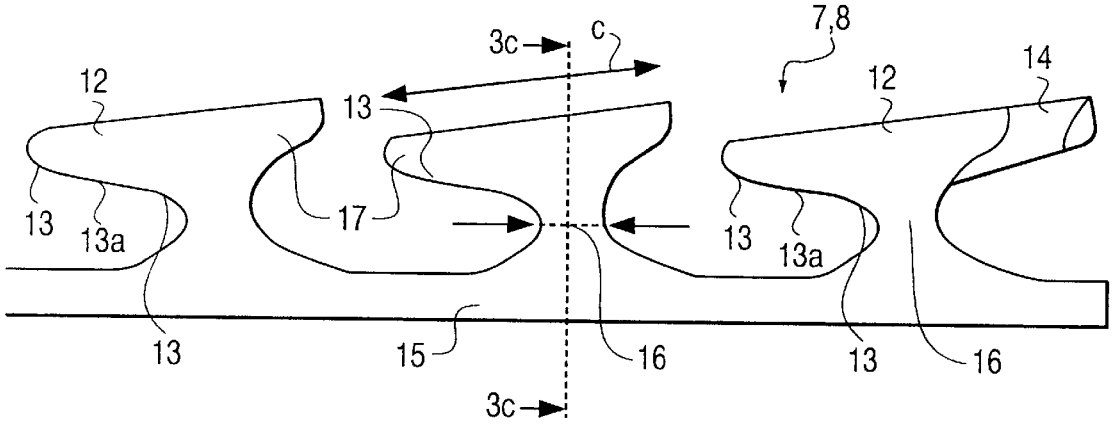

FIGS. 3*a*–3*b* show a terminating part having three pairs of gripping claws 12, in a condition without any conductor inserted. The terminating part is shown in FIG. 3*a* in top view, in FIG. 3*b* in a side view, and in FIG. 3*c* in cross section along line 3*a*–3*c* in FIG. 3*b*. In principle, the size or the inner diameter e of the three claw pairs decreases successively from the right or outer end toward the left or inner end. The gripping claws curve upwardly from base part 15 extending all the way along the terminating part, and each gripping claw has a narrow neck section 16 before expanding again upwardly to a top part 17 that in a relaxed condition has an upper end edge 18 which in the side view is inclined forwardly and downwardly. The edge 18 also extends at a small oblique angle d in relation to the main longitudinal direction of the base part 15, as viewed from above.

Figure 4A:
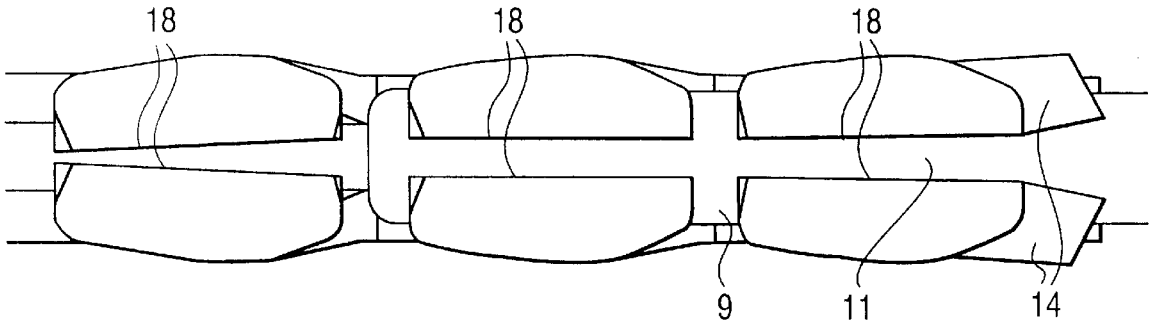
FIGS. 4*a*–4*c* are the same as FIGS. 3*a*–3*c*, however with a conductor inserted and attached in the terminating part.
Figure 4B:
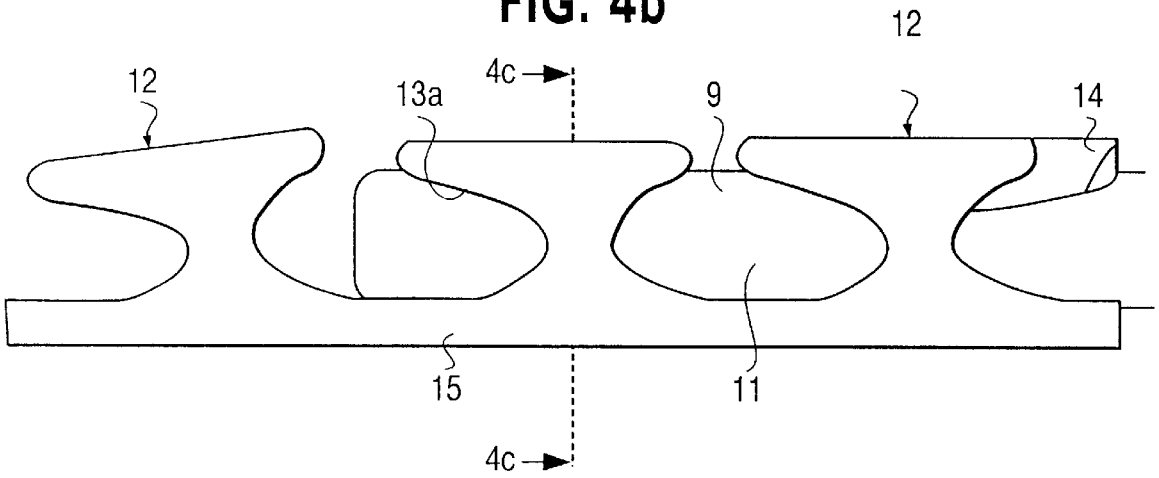

However, a central and crucial feature appears from the side view of FIG. 3*b* namely the curved edge part 13 on the forward underside of each gripping claw, at a position where the gripping claw expands from the narrow neck section 16 to the top part 17. The portion 13, or more specifically a certain intermediate portion 13*a*, exhibits a shape that is specially adapted for helical engagement against a conductor of appropriate size that has been inserted in the claw and has caused the claw to pivot up to a position, as shown in FIG. 4*b*. FIG. 4*b* shows that the metallic conductor 9 has been inserted and has a diameter adapted to the intermediate pair of claws 12. Top parts 17 of the intermediate pair of claws are moved or tilted axially and also laterally in such a manner that edges 18 of the intermediate claw extend parallel to the longitudinal direction of the base part 15, which corresponds to the longitudinal direction of the conductor. Also, such top parts enclose the surface 11 of the conductor tightly. In this situation the portion 13*a*, or more specifically the inner edge portion 13*a*, engages the surfaces 11 along a helical line of high pitch, i.e. a large pitch angle.

The inner edge of portion 13*a* of the top part 17 and closes the conductor in a spring-like and tight manner, thus provides the following effect: If an attempt is now made to pull the insulated conductor 10 rearwardly, the inner edge of the portion 13*a* will bite and lock itself into the surface 11 of the metal conductor. This inner edge is made particularly sharp in order to provide a scoring/carving effect when such a withdrawal of the metallic conducted 9 is attempted. The consequence is then that the top portion 17 tends to pivot forward, which provides a further scoring and locking effect. The total effect will be that he metallic conductor 9 is locked in its position, and the terminating part is secured.

When terminating or connecting is to be effected, the metallic conductors is pushed forward between the pairs of gripping claws 12. The gripping claws make electrical contact in a spring-like stressed manner, partly by a force causing the forward end of each gripping claw 12 to be pressed upwardly and outwardly by, and partly by a force causing the distance between the stressed gripping claws to become slightly larger. This appears clearly from FIGS. 2*c* and 2*d*. At the same time the gripping claws 12 will, for a moderate pulling force, lock the metallic conductor 9 if it is pulled rearwardly, since the gripping claws will carve into the conductor surface 11 with portions 13*a* as explained above.

Normally the conductor material will be a soft metal, pure copper or tin coated/silver coated copper with a high electrical conductivity.

By arranging several pairs of gripping claws 12 in a successive row, such as appears from the example shown, where grip height and gap between the gripping claws are diminished gradually or step-wise from one pair to the next, a terminating part 7, 8 will be able to terminate or connect to metallic solid conductors 9 having various diameters. For example, commonly used conductor diameters in a low current cable between 0.5 and 0.64 mm may be connected to the same contact pin or socket.

Figure 3C:
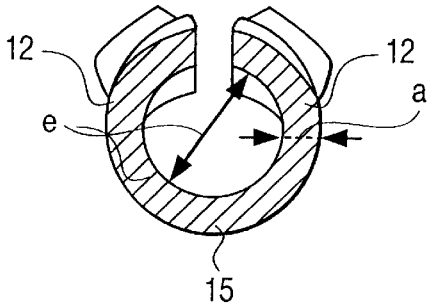

The terminating part constituting the essential feature of the invention, must be made from a springy or spring-like material having good conduction characteristics., e.g. phosphor bronze or beryllium copper. The terminating part with the gripping claws can advantageously be shaped in a combined stamping and bending tool from a flat metal piece. A typical material thickness may be 0.16 mm. Important design parameters will be:

material thickness of the metal piece (see FIG. 3*c,a*)

width of neck section 16 length of top part 17 for each pair gripping claws 12 (see FIG. 3*b,c*)

twist angle d for top part 17 smallest enclosing diameter (see FIG. 3*c,e*), and the profile shape 13 of the forward part of each gripping claw 12.

These parameters shall be mutually tuned so that the resultant spring load allows entry of the metallic conductor 9 by means of moderate manual force. At the same time the twist angle d for the top part 17 in question, the smallest claw enclosure diameter e and the profile 13 on the forward part of each gripping claw shall be tuned in such a manner that the griping claws 12 enclose the metallic conductor 9 as tight as possible, provide a pressure on surface 11 that is distributed as uniformly as possible, and in particular a resistance that is as large as possible, by means of biting/carving, if an attempt is made to pull the metallic conductor 9 is rearwardly, such as mentioned above.

Figure 4C:
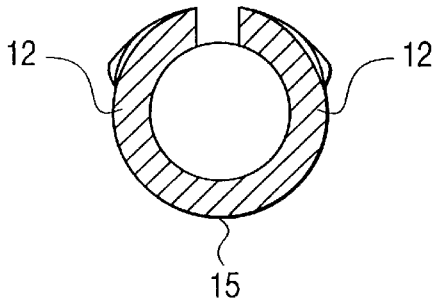

It is favorable if the outermost claw pair 12 is provided with outwardly tapered, funnel-shaped conductor entry parts 14 in order to simplify insertion of the tip of the metallic conductor 9. Such parts 14 are shown in the drawings, and constitute as shown in FIG. 3*c*, top ears or projections pointing outwardly. It is to be noted at the same time that in the same section also appear, as inward pointing edges in the upper part of the circle, the forward tips of gripping claws 12 to the extreme right in FIG. 3*b*. In the section of FIG. 4*c*, the parts 14 appear just scarcely as small ears or projections pointing outwardly, because the right pair of claws in this condition, with a metallic conductor 9 inserted, are partly pivoted toward horizontal positions. In FIG. 4*c*, the inner space of the pair of claws is filled by the metallic conductor 9.

Finally, a terminating part of the type shown in connection with pins and sockets for use in plug and socket contacts, advantageously can be used as pure terminating parts e.g. soldered to a printed circuit board, either standing perpendicularly to the circuit board or edge mounted according to conventional techniques. Besides, the terminating part in accordance with the invention also may be connected to contact parts of general contact pieces, i.e. types of contact parts other than pins and sockets as mentioned above.

What is claimed is:

1. A contact pin for use with a contact socket, said contact pin including a forward engagement pin part to be inserted into the contact socket and a rear terminating pin part to be connected to a metallic conductor having a substantially circular cylindrical surface, said terminating pin part comprising:

at least one pair of gripping claws formed of an electrically conductive material to provide good electrical contact with the metallic conductor;

each said gripping claw having a substantially semi-cylindrical configuration and being axially tiltable in a spring-like manner, such that when the metallic conductor is inserted in a forward direction between said pair of gripping claws, said pair of gripping claws substantially cylindrically enclose and grip the metallic conductor under stress; and each said gripping claw having a forwardly facing portion having an edge to be in contact with the surface of the metallic conductor along a substantially helical curve having a large pitch angle such that, when an attempt is made to pull the metallic conductor rearwardly, said edge will carve into the surface of the metallic conductor and lock to the metallic conductor.

2. A contact pin as claimed in claim 1, wherein said terminating pin part is shaped by stamping and bending from a flat metal member.

3. A contact pin as claimed in claim 1, wherein said terminating pin part comprises a row of successive pairs of gripping claws having successively narrower passages for connection to metallic conductors of different diameters.

4. A contact pin as claimed in claim 3, wherein a rearwardly located first said pair of gripping claws of said row has at an entry side thereof an outwardly-tapered, funnel-shaped entry part to facilitate entry of a tip end of the metallic conductor.

5. A contact pin as claimed in claim 1, wherein said terminating pin part further comprises a base part extending in a longitudinal direction to be parallel to a direction of insertion of the metallic member between said pair of gripping claws.

6. A contact pin as claimed in claim 5, wherein said gripping claws extend from said base part in opposite directions laterally of said longitudinal direction.

7. A contact pin as claimed in claim 6, wherein each said gripping claw is curved substantially semi-cylindrically in a respective said lateral direction from said base part.

8. A contact pin as claimed in claim 6, wherein each said gripping claw has a neck part having a narrow dimension in said longitudinal direction and extending from said base part to a top part having a large dimension in said longitudinal direction.

9. A contact pin as claimed in claim 8, wherein said top part has an end edge directed toward a corresponding end edge of the other said gripping claw of said pair, said end edge extending parallel to said longitudinal direction when said gripping claws are in a position to grip the metallic conductor, and said end edge extending at an oblique angle to said longitudinal direction when said gripping claws are in a position wherein the metallic conductor is not gripped.

10. A contact pin as claimed in claim 8, wherein said edge extends from said neck part to said top part.

11. A contact socket for use with a contact pin, said contact socket including a forward engagement socket part to have inserted therein the contact pin and a rear terminating socket part to be connected to a metallic conductor having a substantially circular cylindrical surface, said terminating socket part comprising:

at least one pair of gripping claws formed of an electrically conductive material to provide good electrical contact with the metallic conductor;

each said gripping claw having a substantially semi-cylindrical configuration and being axially tiltable in a spring-like manner, such that when the metallic conductor is inserted in a forward direction between said pair of gripping claws, said pair of gripping claws substantially cylindrically enclose and grip the metallic conductor under stress; and each said gripping claw having a forwardly facing portion having an edge to be in contact with the surface of the metallic conductor along a substantially helical curve having a large pitch angle such that, when an attempt is made to pull the metallic conductor rearwardly, said edge will carve into the surface of the metallic conductor and lock to the metallic conductor.

12. A contact socket as claimed in claim 11, wherein said terminating socket part is shaped by stamping and bending from a flat metal member.

13. A contact socket as claimed in claim 11, wherein said terminating socket part comprises a row of successive pairs of gripping claws having successively narrower passages for connection to metallic conductors of different diameters.

14. A contact socket as claimed in claim 13, wherein a rearwardly located first said pair of gripping claws of said row has at an entry side thereof an outwardly-tapered, funnel-shaped entry part to facilitate entry of a tip end of the metallic conductor.

15. A contact socket as claimed in claim 11, wherein said terminating socket part further comprises a base part extending in a longitudinal direction to be parallel to a direction of insertion of the metallic member between said pair of gripping claws.

16. A contact socket as claimed in claim 15, wherein said gripping claws extend from said base part in opposite directions laterally of said longitudinal direction.

17. A contact socket as claimed in claim 16, wherein each said gripping claw is curved substantially semi-cylindrically in a respective said lateral direction from said base part.

18. A contact socket as claimed in claim 16, wherein each said gripping claw has a neck part having a narrow dimension in said longitudinal direction and extending from said base part to a top part having a large dimension in said longitudinal direction.

19. A contact socket as claimed in claim 18, wherein said top part has an end edge directed toward a corresponding end edge of the other said gripping claw of said pair, said end edge extending parallel to said longitudinal direction when said gripping claws are in a position to grip the metallic conductor, and said end edge extending at an oblique angle to said longitudinal direction when said gripping claws are in a position wherein the metallic conductor is not gripped.

20. A contact socket as claimed in claim 18, wherein said edge extends from said neck part to said top part.

21. A terminating part for use in connecting a metallic conductor to a contact pin or to a contact socket, said terminating part comprising:

at least one pair of gripping claws formed of an electrically conductive material to provide good electrical contact with the metallic conductor;

each said gripping claw having a substantially semi-cylindrical configuration and being axially tiltable in a spring-like manner, such that when the metallic conductor is inserted in a forward direction between said pair of gripping claws, said pair of gripping claws substantially cylindrically enclose and grip the metallic conductor under stress; and each said gripping claw having a forwardly facing portion having an edge to be in contact with the surface of the metallic conductor along a substantially helical curve having a large pitch angle such that, when an attempt is made to pull the metallic conductor rearwardly, said edge will carve into the surface of the metallic conductor and lock to the metallic conductor.

22. A terminating part as claimed in claim 21, shaped by stamping and bending from a flat metal member.

23. A terminating part as claimed in claim 21, comprising a row of successive pairs of gripping claws having successively narrower passages for connection to metallic conductors of different diameters.

24. A terminating part as claimed in claim 23, wherein a rearwardly located first said pair of gripping claws of said row has at an entry side thereof an outwardly-tapered, funnel-shaped entry part to facilitate entry of a tip end of the metallic conductor.

25. A terminating part as claimed in claim 21, further comprising a base part extending in a longitudinal direction to be parallel to a direction of insertion of the metallic member between said pair of gripping claws.

26. A terminating part as claimed in claim 25, wherein said gripping claws extend from said base part in opposite directions laterally of said longitudinal direction.

27. A terminating part as claimed in claim 26, wherein each said gripping claw is curved substantially semi-cylindrically in a respective said lateral direction from said base part.

28. A terminating part as claimed in claim 26, wherein each said gripping claw has a neck part having a narrow dimension in said longitudinal direction and extending from said base part to a top part having a large dimension in said longitudinal direction.

29. A terminating part as claimed in claim 28, wherein said top part has an end edge directed toward a corresponding end edge of the other said gripping claw of said pair, said end edge extending parallel to said longitudinal direction when said gripping claws are in a position to grip the metallic conductor, and said end edge extending at an oblique angle to said longitudinal direction when said gripping claws are in a position wherein the metallic conductor is not gripped.

30. A terminating part as claimed in claim 28, wherein said edge extends from said neck part to said top part.

31. A contact assembly including a socket contact having contact sockets, and a plug contact having contact pins to be inserted into said contact sockets, each said contact socket and said contact pin having a forward engagement, and each said contact socket and said contact pin having a rear terminating part to be connected to a respective metallic conductor having a substantially circular cylindrical surface, said terminating part comprising:

at least one pair of gripping claws formed of an electrically conductive material to provide good electrical contact with the metallic conductor;

each said gripping claw having a substantially semi-cylindrical configuration and being axially tiltable in a spring-like manner, such that when the metallic conductor is inserted in a forward direction between said pair of gripping claws, said pair of gripping claws substantially cylindrically enclose and grip the metallic conductor under stress; and each said gripping claw having a forwardly facing portion having an edge to be in contact with the surface of the metallic conductor along a substantially helical curve having a large pitch angle such that, when an attempt is made to pull the metallic conductor rearwardly, said edge will carve into the surface of the metallic conductor and lock to the metallic conductor.

32. An assembly as claimed in claim 31, wherein said terminating part is shaped by stamping and bending from a flat metal member.

33. An assembly as claimed in claim 31, wherein said terminating part comprises a row of successive pairs of gripping claws having successively narrower passages for connection to metallic conductors of different diameters.

34. An assembly as claimed in claim 33, wherein a rearwardly located first said pair of gripping claws of said row has at an entry side thereof an outwardly-tapered, funnel-shaped entry part to facilitate entry of a tip end of the metallic conductor.

35. An assembly as claimed in claim 31, further comprising a base part extending in a longitudinal direction to be parallel to a direction of insertion of the metallic member between said pair of gripping claws.

36. An assembly as claimed in claim 35, wherein said gripping claws extend from said base part in opposite directions laterally of said longitudinal direction.

37. An assembly as claimed in claim 36, wherein each said gripping claw is curved substantially semi-cylindrically in a respective said lateral direction from said base part.

38. An assembly as claimed in claim 36, wherein each said gripping claw has a neck part having a narrow dimension in said longitudinal direction and extending from said base part to a top part having a large dimension in said longitudinal direction.

39. An assembly as claimed in claim 38, wherein said top part has an end edge directed toward a corresponding end edge of the other said gripping claw of said pair, said end edge extending parallel to said longitudinal direction when said gripping claws are in a position to grip the metallic conductor, and said end edge extending at an oblique angle to said longitudinal direction when said gripping claws are in a position wherein the metallic conductor is not gripped.

40. An assembly as claimed in claim 38, wherein said edge extends from said neck part to said top part.

* * * * *